US008546672B1

(12) United States Patent
Pinzone

(10) Patent No.: US 8,546,672 B1
(45) Date of Patent: Oct. 1, 2013

(54) APPARATUS FOR PLAYING A STRINGED INSTRUMENT

(76) Inventor: Joseph F. Pinzone, Newbury, OH (US)

( * ) Notice: Subject to any disclaimer, the term of this patent is extended or adjusted under 35 U.S.C. 154(b) by 3 days.

(21) Appl. No.: 13/429,391

(22) Filed: Mar. 25, 2012

(51) Int. Cl.
*G10D 3/16* (2006.01)

(52) U.S. Cl.
USPC ..... 84/320

(58) Field of Classification Search
USPC ..... 84/320
See application file for complete search history.

(56) References Cited

U.S. PATENT DOCUMENTS

| | | | | | |
|---|---|---|---|---|---|
| 389,137 | A * | 9/1888 | Crawford | 84/320 |
| 606,813 | A * | 7/1898 | Reed | 84/8 |
| 628,851 | A * | 7/1899 | Reed | 84/320 |
| 666,710 | A * | 1/1901 | Spence | 84/173 |
| 677,584 | A * | 7/1901 | Mitchell | 84/320 |
| 680,305 | A * | 8/1901 | Wilburn | 84/320 |
| 1,716,747 | A * | 6/1929 | Warner | 84/320 |
| 1,871,021 | A * | 8/1932 | Zachrison | 84/8 |
| 2,006,998 | A * | 7/1935 | Marzullo | 84/320 |
| 2,380,689 | A * | 7/1945 | Goodwin | 84/320 |
| 3,146,657 | A * | 9/1964 | Joslyn | 84/9 |
| 3,293,975 | A * | 12/1966 | Koniecki | 84/320 |
| 3,443,468 | A * | 5/1969 | Kidwell | 84/315 |
| 3,882,754 | A * | 5/1975 | Godley et al. | 84/320 |
| 4,037,503 | A | 7/1977 | Jacobson | |
| 4,227,434 | A | 10/1980 | DiMarzio | |
| 5,212,330 | A * | 5/1993 | Cooper | 84/320 |
| 5,393,925 | A * | 2/1995 | Wilson | 84/9 |
| 6,723,904 | B1 * | 4/2004 | Dolan et al. | 84/267 |
| 7,285,709 | B2 * | 10/2007 | White et al. | 84/321 |
| 7,968,779 | B2 * | 6/2011 | Courtright et al. | 84/320 |
| 8,314,322 | B2 * | 11/2012 | Langberg | 84/723 |

OTHER PUBLICATIONS

Bohs, et al.; "Wheelchair Desk," Chapter 7, Duke University, School of Egineeing, Dept. of Biomedical Engineering, NSF 2000 Engineering Senior Design Projecs of Aid Persons with Disabilities; pp. 57-72.

* cited by examiner

*Primary Examiner* — David Warren
*Assistant Examiner* — Robert W Horn
(74) *Attorney, Agent, or Firm* — Thomas Horstemeyer, LLP

(57) ABSTRACT

Disclosed are various embodiments for an apparatus for playing a stringed instrument that has a surface facing multiple strings. The apparatus includes an input device and a carriage assembly having multiple picks configured to sound strings of the stringed instrument. In response to data received from the input device, the picks are configured to move across the strings from a first position, with the strings between the picks and the surface of the stringed instrument, to a second position, with the picks between the strings and the surface of the stringed instrument.

20 Claims, 9 Drawing Sheets

APPARATUS FOR PLAYING A STRINGED INSTRUMENT

BACKGROUND

Many stringed musical instruments, such as guitars, banjos, mandolins, violins, ukuleles, and the like, typically require the use of two hands in order to be played. As such, individuals who do not have full function of both of their hands may not be able to play these instruments.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, the same reference numerals designate corresponding parts throughout the several views.

DETAILED DESCRIPTION

The present disclosure is directed towards an apparatus that may facilitate playing a stringed instrument with the use of one hand. As used herein, a stringed instrument may be, for example but not limited to, a guitar, a banjo, a ukulele, a mandolin, a violin, or other type of instrument having strings that may be plucked and/or strummed.

In accordance with the present disclosure, a user may use a foot or other body part to contact one or more sensors of an input device. In response to the one or more particular sensors that were contacted, pick assemblies may "pick" one or more strings that correspond to the sensors. By "picking" a string, the string is set into vibration causing a sound to resonate from the stringed instrument. Because one or more sensors correspond to each of the strings of the stringed instrument, a user may "pick" individual strings or "strum" multiple strings as will be described later. Additionally, the apparatus described herein may respond to the intensity at which the sensors are contacted, thereby providing for a sound intensity and dynamic range that responds to the user. In the following discussion, a general description of the system and its components is provided, followed by a discussion of the operation of the same.

Figure 1A:
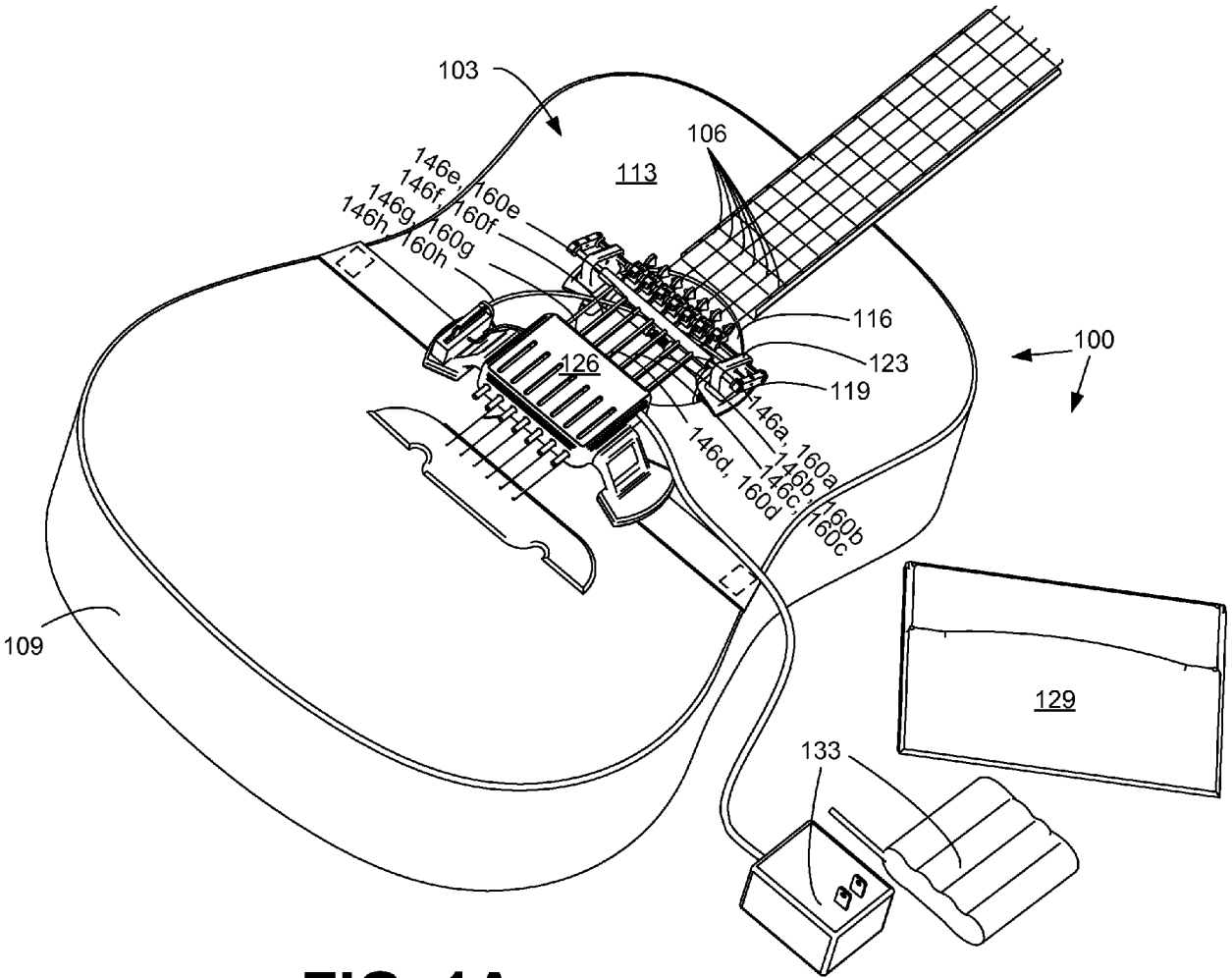
FIGS. 1A-1B are drawings of a picking apparatus according to various embodiments of the present disclosure.
Figure 1B:
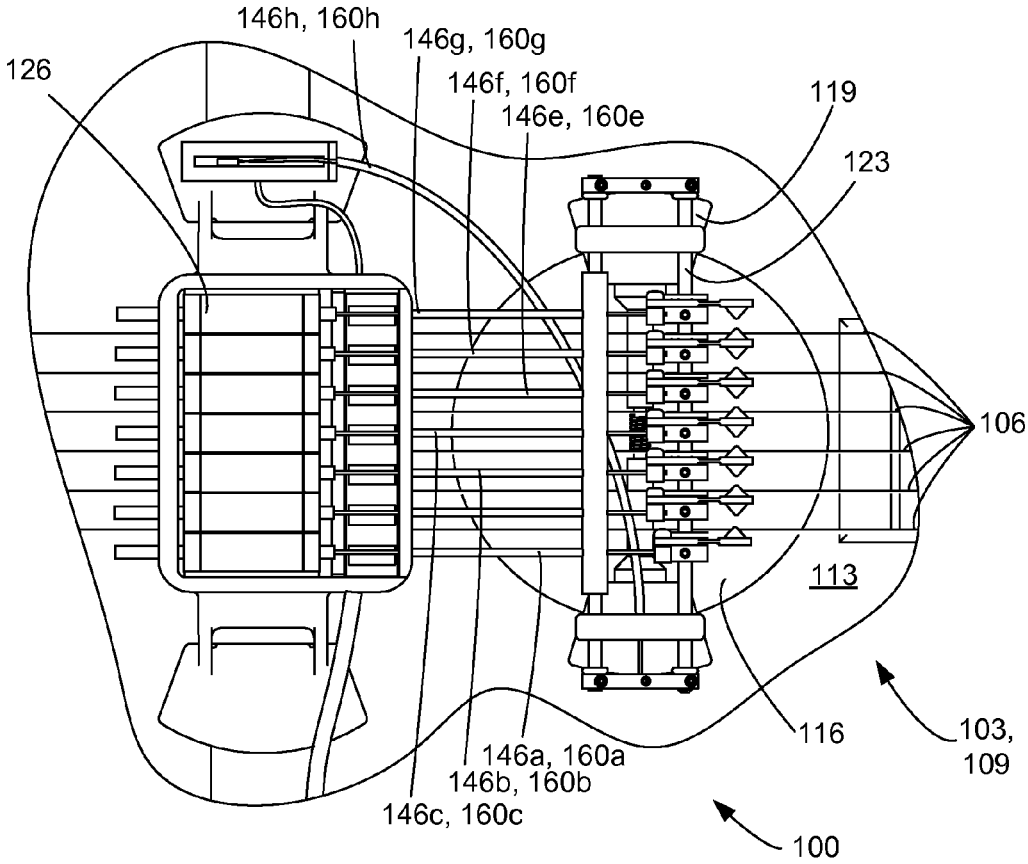

With reference to FIGS. 1A-1B, shown is a picking apparatus 100 configured to facilitate playing a stringed instrument 103 according to various embodiments. Although shown as a guitar, it is emphasized that the stringed instrument 103 in other embodiments may be, for example but not limited to, a banjo, a ukulele, a mandolin, a violin, or any other type of instrument having strings 106 that may be plucked and/or strummed.

The stringed instrument includes a plurality of strings 106, a body 109, and other components not discussed in detail herein. The strings 106 may be set into vibration upon being picked, pluck, strummed, etc., thereby producing sound. The body 109 may facilitate resonance and/or acoustic amplification of the sound. In various embodiments, the body 109 may be solid (e.g., in the case that the stringed instrument 103 is an electric guitar) or hollow (e.g., in the case that the stringed instrument is an acoustic guitar).

The body 109 includes a surface 113 that faces the strings 106. In the event that the stringed instrument 103 has a hollow body 109, the stringed instrument 103 may further include a sound hole 116. In addition to typically amplifying the sound level of the stringed instrument 103, in accordance with the present disclosure, the sound hole 116 may facilitate attachment of the picking apparatus 100 as will be described later.

The picking apparatus 100 may include a mount assembly 119, a carriage assembly 123, an actuator assembly 126, an input device 129, a power supply 133, multiple links 146*a*-146*h*, multiple sheaths 160*a*-160*h*, and possibly other features not discussed in detail herein. Although referred to herein as a single power supply 133, it is understood that the power supply 133 in alternative embodiments may be multiple power supplies 133.

The power supply 133 may be embodied in the form of an AC/DC adapter, one or more batteries, or any other type of available power supply 133. Additionally, the power supply 133 may be coupled to the various electrical components either directly or indirectly through other electrical components. For example, in the embodiment shown, the power supply 133 is directly coupled to the actuator assembly 126.

The actuator assembly 126 may be configured to provide mechanical forces to facilitate playing the stringed instrument 103 as will be discussed later. To this end, the actuator assembly 126 may be permanently or temporarily attached to the stringed instrument 103.

The links 146*a*-146*h* are coupled between the actuator assembly 126 and the carriage assembly 123. The links 146*a*-146*h* facilitate the transfer of mechanical energy from the actuator assembly 126 to the carriage assembly 123 as will be discussed later. As non-limiting examples, the links 146*a*-146*h* may be embodied in the form of cable, wire, rods, bands, or other types of links 146*a*-146*h*. Additionally, one or more sheaths 160*a*-160*h* may cover at least portions of one or more of the links 146*a*-146*h* in various embodiments. The sheaths 160*a*-160*h* may be attached to the actuator assembly 126 and/or the carriage assembly 123, thereby providing a mechanism for maintaining a constant distance between the actuator assembly 126 and carriage assembly 123.

The carriage assembly 123 may transfer the mechanical energy provided through one or more of the links 146*a*-146*g* into motion that causes one or more of the strings 106 to vibrate, as will be described later. Additionally, the link 146*h* may transfer mechanical motion from the actuator assembly 126 to the carriage assembly 123 to cause the carriage assembly 123 to move in a lateral direction, as will also be described later.

In the embodiment shown, the carriage assembly 123 may be removably attached to the stringed instrument 103. To this end, the carriage assembly 123 may be removably attached to the mount assembly 119. The mount assembly 119 may be attached to the surface 113 of the stringed instrument, with at least a portion of the mount assembly 119 between the strings 106 and the surface 113. With the mount assembly 119 attached to the stringed instrument 103, the carriage assembly may be placed over the strings 106 and attached to the mount assembly 119. Thus, the carriage assembly 123 may be attached to the stringed instrument 103, with the strings 106 passing between the mount assembly 119 and the carriage assembly 123. It is noted that the carriage assembly 123 may attach directly to the stringed instrument 103 in alternative embodiments.

The input device 129 may transmit data to the actuator assembly 126, thereby causing mechanical movement in accordance with the present disclosure. To this end, the input device 129 may be communicatively connected to the actuator assembly 126. Such communication may be wireless or wired, as may be appreciated. The input device 129 may be embodied in the form of, for example, a footpad or other type of input device 129. Thus, a user may interact with the input device 129 in order to play the stringed instrument 103 as will be described later.

Figure 2A:
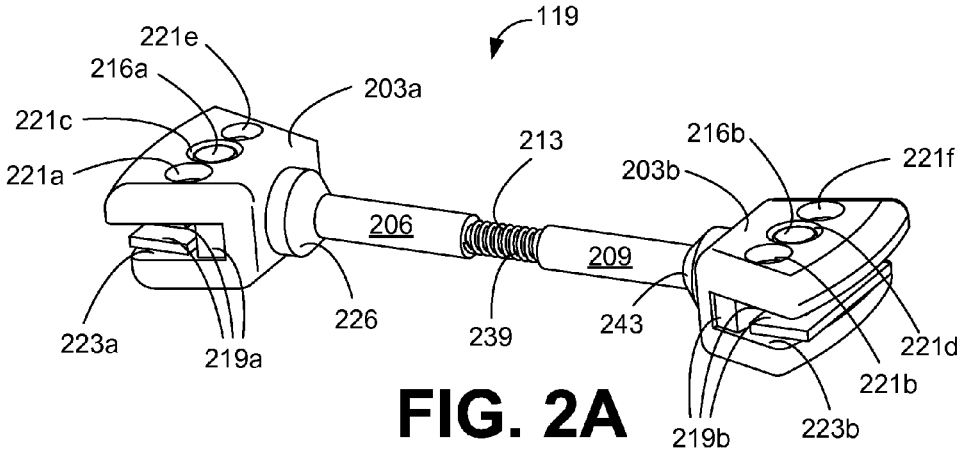
FIGS. 2A-2B are drawings of a mount assembly of the picking apparatus of FIG. 1 according to various embodiments of the present disclosure.
Figure 2B:
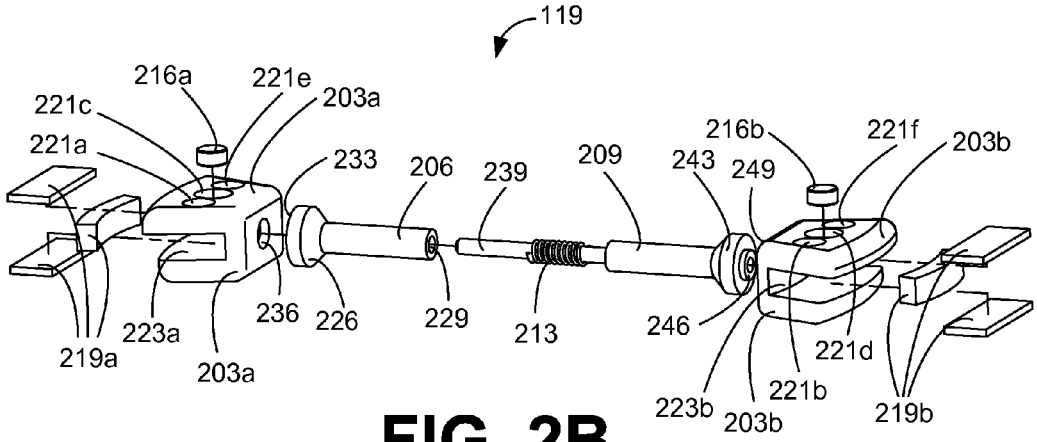

Turning to FIGS. 2A-2B, shown is one example of the mount assembly 119 according to various embodiments. The mount assembly 119 includes multiple braces 203*a*-203*b*, a female rod 206, a male rod 209, a spring 213, magnets 216*a*-216*b*, pads 219*a*-219*b*, recesses 221*a*-221*f* and other components. The braces 203*a*-203*b* are configured to attach to the edge of the sound hole 116 (FIG. 1) of the stringed instrument 103 (FIG. 1). To this end, the braces 203*a*-203*b* may include slots 223*a*-223*b*, which are configured to receive the edge of the sound hole 116.

The pads 219*a*-219*b* may be attached to the slots 223*a*-223*b* of the braces 203*a*-203*b*. The pads 219*a*-219*b* may compress against the edge, top, and/or bottom of the sound hole 116, thereby preventing movement of the braces 203*a*-203*b* with respect to the surface 113 (FIG. 1) of the stringed instrument. Additionally, the pads 219*a*-219*b* may prevent the braces 203*a*-203*b* from causing damage to the stringed instrument 103. Accordingly, the pads 219*a*-219*b* may comprise, for example, foam, rubber, felt, or any other type of material.

The recesses 221*a*-221*f* are depressed regions in the braces 203*a*-203*b* and may facilitate attaching and aligning the carriage assembly 123 (FIG. 1A-1B) to the mount assembly 119. To this end, the recesses 221*c*-221*d* may receive the magnets 216*a*-216*b* such that the magnets 216*a*-216*b* are contained at least partially within the recesses 221*c*-221*d*. Furthermore, the recesses 221*a*-221*b* and 221*e*-221*f* may receive portions of the carriage assembly 123 as will be discussed later.

The female rod 206 includes a flanged end 226 and a bore 229. The flanged end 226 of the female rod 206 is configured to abut and attach to the brace 203*a*. As such, a protrusion 233 (not visible in FIGS. 2A-2B) may insert into a corresponding receptacle 236 in the brace 203*a*. It is understood that the brace 203*a* and female rod 206 may be attached using different mechanisms as well.

The male rod 209 includes an extension 239, a flanged end 243, and a protrusion 246. The flanged end 243 and protrusion 246 of the male rod 209 are similar to the flanged end 226 and protrusion 233 of the female rod 206, described above. The flanged end 243 of the male rod 209 is configured to abut and attach to the brace 203*b*. To this end, the protrusion 246 of the male rod 209 may insert into a corresponding receptacle 249 in the brace 203*b*. As with the female rod 206 and brace 203*a*, the male rod 209 and brace 203*b* may be attached using other mechanisms.

The extension 239 of the male rod 209 may insert into the spring 213. Additionally, the extension 239 of the male rod 209 may insert into the female rod 206 through the bore 229. Due to force provided by the spring 213, the female rod 206 and male rod 209 may expand outwardly against the braces 203*a*-20*b*. In turn, this force may retain the braces 203*a*-203*b* against the edge of the sound hole 116.

Figure 3A:
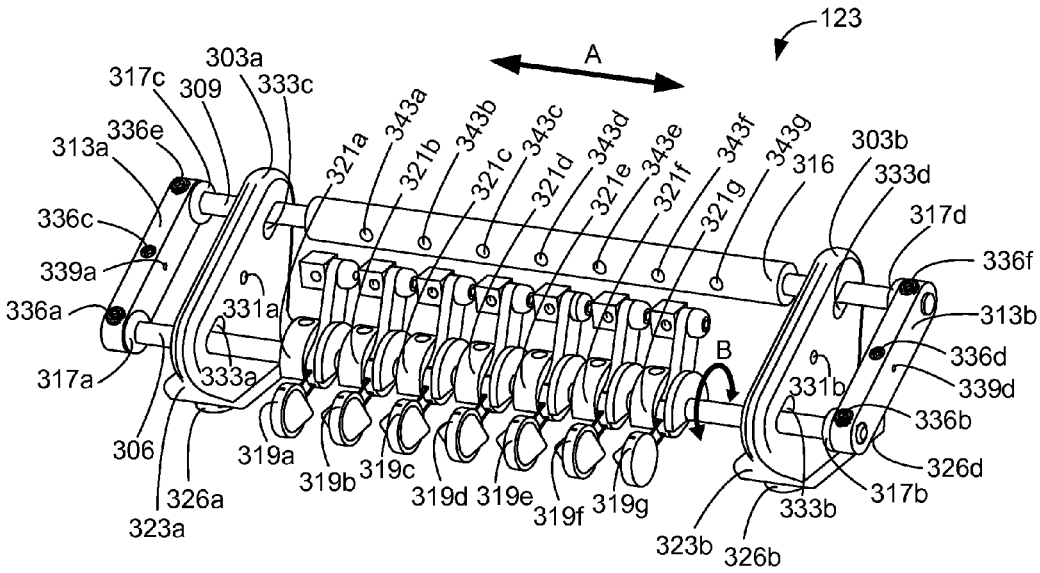
FIGS. 3A-3B are drawings of a carriage assembly of the picking apparatus of FIG. 1 according to various embodiments of the present disclosure.
Figure 3B:
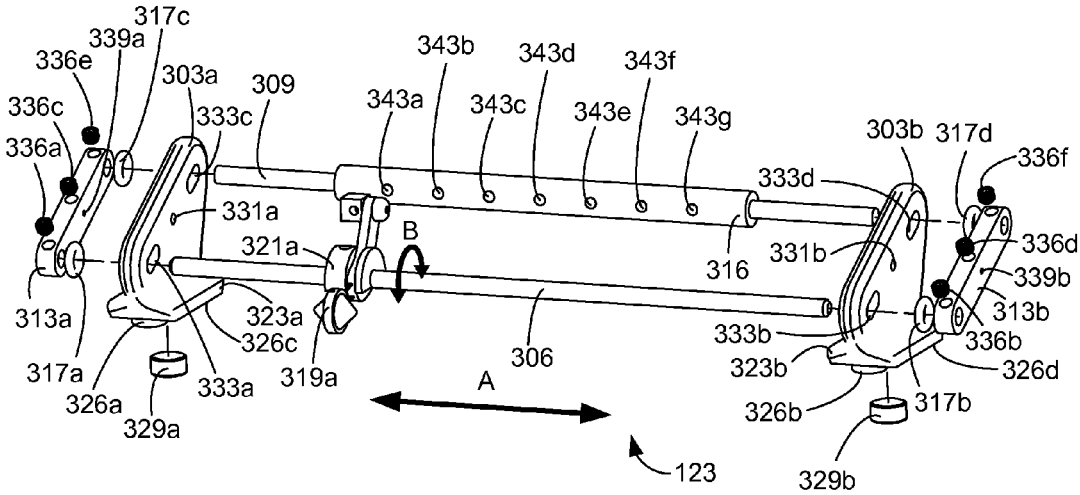

Turning now to FIGS. 3A-3B, shown is one example of the carriage assembly 123 according to various embodiments. The carriage assembly 123 includes supports 303*a*-303*b*, a shaft 306, a rod 309, ends 313*a*-313*b*, a guide 316, dampers 317*a*-317*d*, pick assemblies 319*a*-319*g*, pick assembly guides 321*a*-321*g*, and other features not discussed in detail herein. In FIG. 3B, the pick assemblies 319*b*-319*g* and pick assembly guides 321*b*-321*g* have been removed in order to show various features of the carriage assembly 123.

The supports 303*a*-303*b* include platforms 323*a*-323*b*, feet 326*a*-326*d* (326*c*-326*d* are not visible in the views shown), magnets 329*a*-329*b*, holes 331*a*-331*b*, slots 333*a*-333*d*, and other features not discussed in detail herein. The platforms 323*a*-323*b* in conjunction with the feet 326*a*-326*d* and magnets 329*a*-329*b* may facilitate the carriage assembly 123 being attached to the mount assembly 119 (FIGS. 2A-2B). To this end, the magnets 329*a*-329*b* may be recessed in the platforms 323*a*-323*b* of their respective supports 303*a*-303*b*. The magnets 329*a*-329*b* may align with and magnetically latch to the magnets 216*a*-216*b* (FIGS. 2A-2B).

Further, the feet 326*a*-326*d* may rest in the corresponding recesses 221*a*-221*b* and 221*e*-221*f*. With the carriage assembly 123 attached to the mount assembly 119, these components are thereby coupled together. It is noted that although the present embodiment uses the magnets 329*a*-329*b* to facilitate attachment of the carriage assembly 123 to the mount assembly 119, other embodiments may use other mechanisms for attachment. Additionally, the carriage assembly 123 and/or the mount assembly 119 may be attached to the stringed instrument 103 using other approaches.

A link 146*h* (FIGS. 1A-1B) may pass through the hole 331*a*. For the purposes of convenience, the present disclosure assumes that the link 146*h* passes through the hole 331*a*. However, it is understood that the link 146*h* may instead pass through the hole 331*b*, or multiple links 146*h* may pass through both holes 331*a*-331*b* in alternative embodiments.

The rod 309 is configured to the pass through the slots 333*c*-333*d* of the supports 303*a*-303*b*. Similarly, the shaft 306 is configured to pass through the slots 333*a*-333*b* of the supports 303*a*-303*b*. The rod 309 and/or the shaft 306 may be cylindrical in various embodiments. Additionally, in various embodiments, the rod 309 and shaft 306 are configured to move along the directions indicated by the double-headed arrow A with respect to the supports 303*a*-303*b*.

The ends 313*a*-313*b* may attach to the shaft 306 and the rod 309 as shown. To this end, set screws 336*a*-336*b* may secure the ends 313*a*-313*b* to the shaft 306, and set screws 336*e*-336*f* may secure the ends 313*a*-313*b* to the rod 309. In alternative embodiments, the ends 313*a*-313*b* may be attached to the shaft 306 and rod 309 using, for example, welds, adhesive, fasteners, or other mechanisms.

As described above, the link 146*h* may pass through the hole 331*a*. As such, the end 313*a* may include a receptacle 339*a* configured to receive and retain this link 146*h*. It is noted that the end 313*b* may also include a receptacle 339*b* to simplify manufacturing or for retaining the link 146*h* in alternative embodiments. In order to retain the link 146*h* in the receptacle 339*a* (or receptacle 339*b*), the end 313*a* (or end 313*b*) may include set screw 336*c* (or set screw 336*d*) that may compress and thereby retain the link 146*h*. Thus, as will be described later, the link 146*h* being retained in the receptacle 339*a* (or receptacle 339*b*) may facilitate movement of the end 313*a* (or end 313*b*), and thus the shaft 306 and the rod 309, in the directions indicated by the double-headed arrow A.

The dampers 317*a*-317*b* are configured to be placed over the shaft 306, and the dampers 317*c*-317*d* are configured to be placed over the rod 309. The dampers 317*a*-317*d* may provide cushioning to the extent that the supports 303*a*-303*b* may contact the ends 313*a*-313*b*. As such, the dampers 317*a*-317*d* may comprise compressible material (e.g., rubber) or other material. Accordingly, the dampers 317*a*-317*d* may be embodied in the form of O-rings. However, other types of dampers 317*a*-317*d* may be used as well.

The guide 316 may fit over the rod 309. In alternative embodiments, the guide 316 may be formed as part of the rod 309. The guide 316 comprises multiple holes 343*a*-343*g* extending through the guide 316. The holes 343*a*-343*g* are configured to receive the sheaths 160*a*-160*g* (FIGS. 1A-1B) and therefore lead the links 146*a*-146*g* to the pick assemblies 319*a*-319*g*. To this end, the holes 343*a*-343*g* may pass through the rod 309.

The pick assemblies 319*a*-319*g* are configured to rotatably mount to the to the shaft 306. In this sense, the pick assemblies 319*a*-319*g* may rotate in the direction indicated by the double-headed arrow B. In order to prevent movement of the pick assemblies 319*a*-319*g* along the shaft 306 (i.e., in the directions of the double-headed arrow A), the pick assembly guides 321*a*-321*g* fixedly mount to the shaft 306 and straddle the pick assemblies 319*a*-319*g*.

Figure 4A:
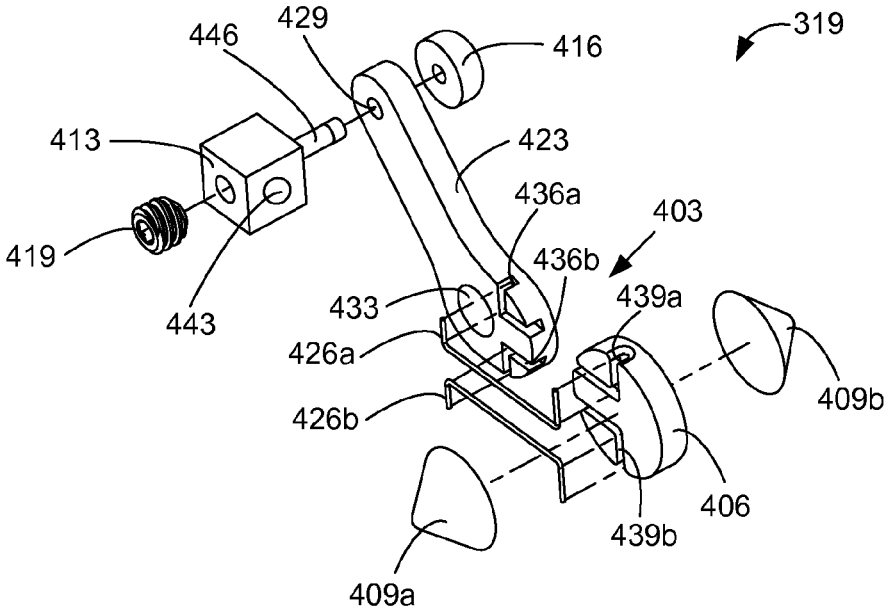
FIGS. 4A-4B are drawings of a pick assembly of the carriage assembly of FIGS. 3A-3B according to various embodiments of the present disclosure.
Figure 4B:
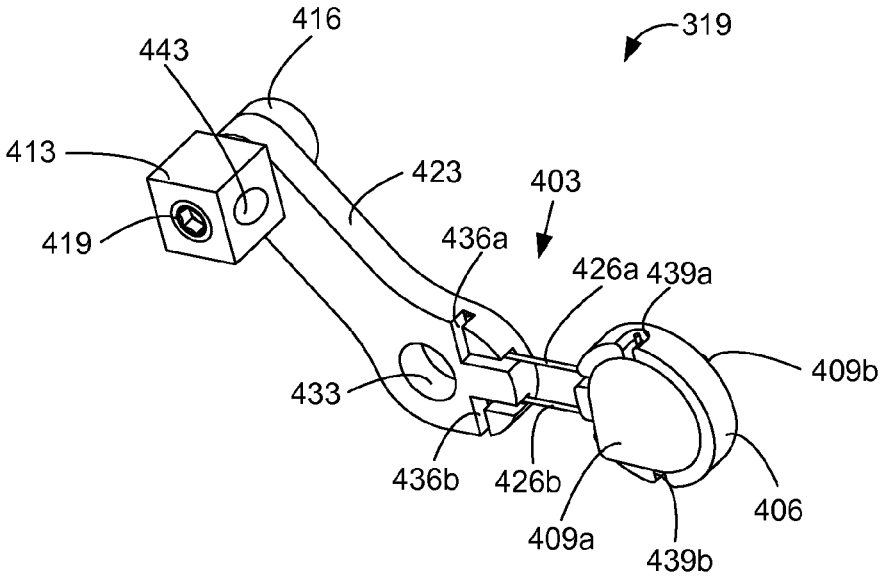

Turning to FIGS. 4A-4B, shown is one of the pick assemblies 319*a*-319*g*, referred to herein as pick assembly 319, according to various embodiments of the present disclosure. The pick assembly 319 may include an arm 403, one or more picks 409*a*-409*b*, a terminal 413, a retainer 416, a set screw 419, and possibly other features not discussed in detail herein.

The arm 403 may transfer linear mechanical motion provided by one of the links 146*a*-146*g* (FIGS. 1A-1B) into rotational motion that causes one or more picks 409*a*-409*b* to strike one or more of the strings 106 (FIGS. 1A-1B). To this end, the arm 403 may include a lever 423 one or more extensions 426*a*-426*b*, a junction 406, and possibly other components. It is noted that in alternative embodiments, the arm 403 (as well as other components) may be embodied in the form of a single component.

The lever 423 may include an eye 429, a hole 433, and slots 436*a*-436*b*. The shaft 306 (FIGS. 3A-3B) may slide into the hole 433, and the pick assembly 319 may thereby rotate about the shaft 309. The slots 436*a*-436*b* may receive and retain the extensions 426*a*-426*b*. The extensions 426*a*-426*b* in various embodiments may comprise a flexible material in order to facilitate the picks 409*a*-409*b* overcoming the strings 106 upon the pick assembly 319 rotating about the shaft 309. Additionally, the flexible material may dampen or limit various impact forces from being transferred to the pick assembly 319.

The junction 406 may include grooves 439*a*-439*b* to receive and retain the extensions 426*a*-426*b*. Additionally, the junction 406 may serve as a connection to the picks 409*a*-409*b*. Furthermore, the pick 409*a* may facilitate retaining the extensions 426*a*-426*b* to the junction 406, as shown. In various alternative embodiments, the lever 403 and/or junction 406 may be molded around the extensions 426*a*-426*b*.

Additionally, it is noted that characteristics of the extensions 426*a*-426*b* may vary according to the gauge of the corresponding string 106 (FIGS. 1A-1B). For example, a relatively more flexible extension 426 may be used for a relatively light gauge string 106, while a relatively more rigid extension 426 may be used for a relatively heavy gauge string 106.

The picks 409*a*-409*b* are configured to "pick," "strum," or otherwise cause the strings 106 to vibrate thereby creating sound. The picks 409*a*-409*b* may be axially symmetrical or any other shape. For example, the picks 409*a*-409*b* may be conical in shape. By being axially symmetrical, the picks 409*a*-409*b* may accommodate varying distances to the strings 106 due to, for example, a user fretting the strings 106.

Additionally, in various embodiments the pick 409*a* may comprise different materials, shapes, textures, etc. than the pick 409*b*. As a non-limiting example, pick 409*a* may comprise rubber, while pick 409*b* may comprise a relatively harder nylon. Because the nylon is harder than the rubber, pick 409*a* and pick 409*b* may create different dynamics or tones upon "picking" a string 106. Additionally, the material of a pick 409*a*-409*b* may be selected to simulate the touch produced by a human finger plucking a string. To this end, the material may be, for example, leather, a micro-textured material, or another material.

The terminal 413 includes a hole 443 and an extension 446. The extension 446 may pass through the eye 429 of the lever 423 and insert into the retainer 416, thereby facilitating rotation of the terminal 413 about an axis formed by the extension 446. The hole 443 of the terminal 413 may receive one of the links 146*a*-146*g* (FIGS. 1A-1B), and one of the links 146*a*-146*g* may be retained by the set screw 419. Thus, linear movement of one of one of the links 146*a*-146*g* may cause the pick assembly 319 to rotate about the shaft 306, causing one of the picks 409*a*-409*b* to "pick" a string 106.

Figure 5A:
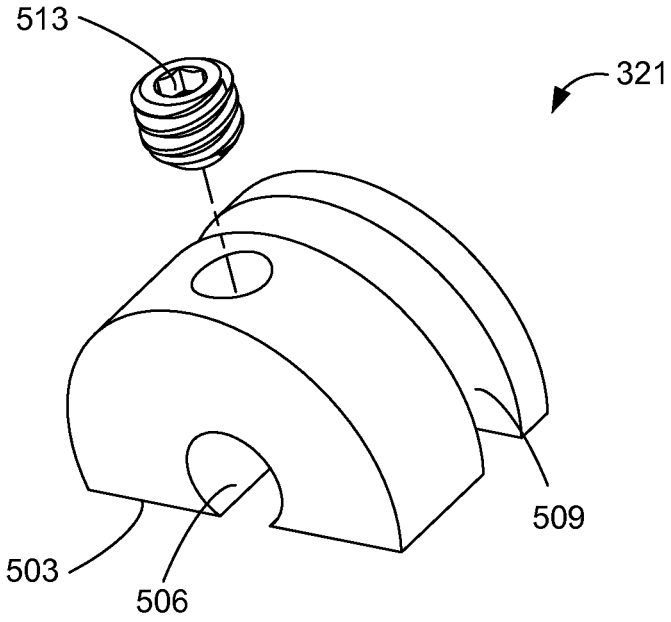
FIGS. 5A-5B are drawings of a pick assembly guide of the carriage assembly of FIGS. 3A-3B according to various embodiments of the present disclosure.
Figure 5B:
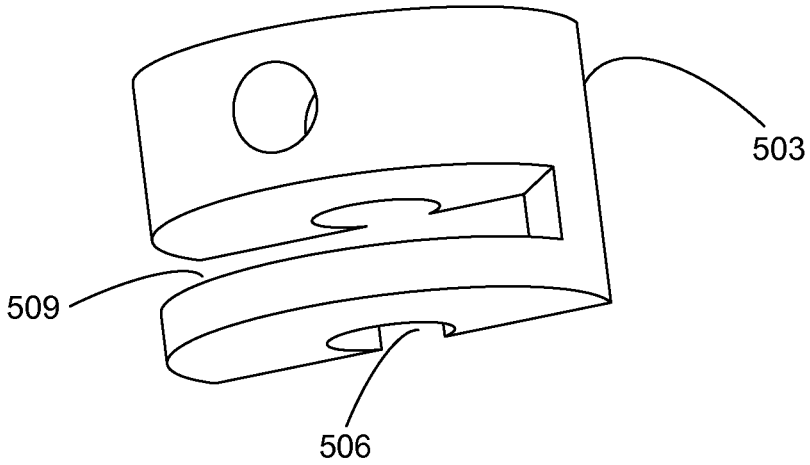

Turning to FIGS. 5A-5B, shown is one embodiment, among others, of one of the pick assembly guides 321*a*-321*g*, herein referred to as pick assembly guide 321. In the embodiment shown, the pick assembly guide 321 is substantially disk-shaped with a flat base 503. By having a flat base 503, the pick assembly guide 321 may avoid making contact or interfering with the strings 106 (FIGS. 1A-1B). The pick assembly guide 321 further includes a hole 506, a slot 509, a set screw 513, and other features not discussed in detail herein.

The hole 506 may receive and at least partially surround the shaft 306 (FIGS. 3A-3B). The slot 509 is configured to accommodate the lever 423 (FIGS. 4A-4B) of the pick assembly 319 (FIGS. 4A-4B). The slot 509 may facilitate the pick assembly guide 321 straddling one of the pick assembles 319*a*-319*g* upon assembly of the carriage assembly 123 (FIGS. 3A-3B), as best shown in FIGS. 3A-3B.

The set screw 513 facilitates attaching the pick assembly guide 321 to the shaft 306 and preventing movement of the pick assembly guide 321 with respect to the shaft 306. Thus, with the pick assembly guide 321 straddling the pick assembly 319 and being secured to the shaft 306, the pick assembly guide 321 is prevented from moving along the shaft 306. However, the pick assembly 319 may rotate about the shaft 306, and the pick assembly 319 may move with the shaft 306 in the directions indicated by the double-headed arrow A (FIGS. 3A-3B).

Figure 6:
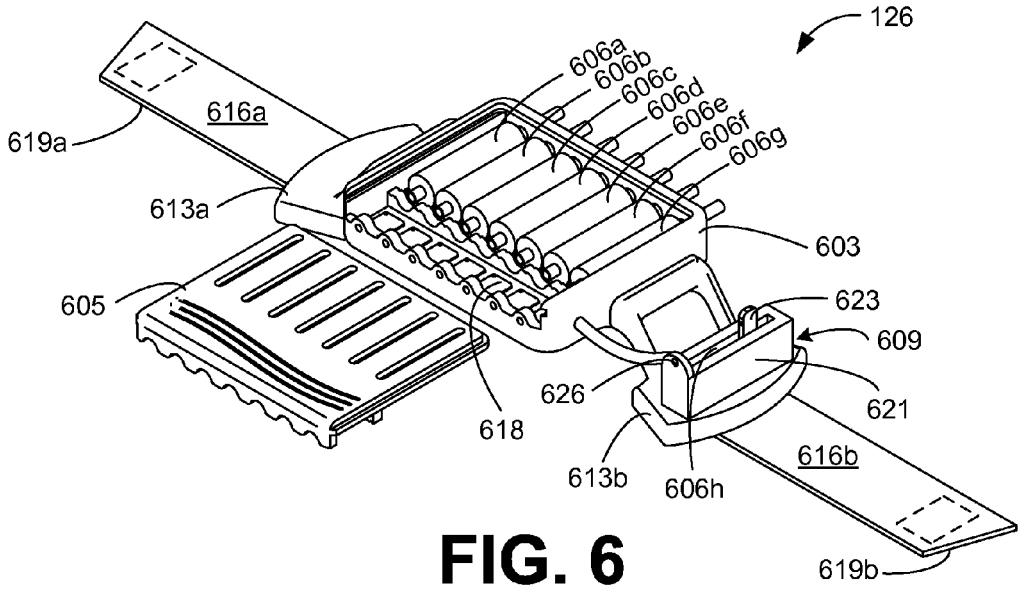
FIG. 6 is a drawing of an actuator assembly of the picking apparatus of FIG. 1 according to various embodiments of the present disclosure.

Turning now to FIG. 6, shown is the actuator assembly 126 according to various embodiments of the present disclosure. The actuator assembly 126 may include an enclosure 603, multiple actuators 606*a*-606*g*, a carriage positioning unit 609, one or more supports 613*a*-613*b*, one or more straps 616*a*-616*b*, a controller device 618, and possibly other components not discussed in detail herein.

The enclosure 603 may provide a housing and protection for the actuators 606, the controller device 618 and other components. The controller device 618 facilitates control of the actuator assembly 126 and wired and/or wireless data communication with the input device 129 (FIGS. 1A-1B) as may be appreciated. To this end, the controller device 618 may include, for example but not limited to, a microcontroller and/or other type of controller.

The enclosure 603 may also include a cover 605. The actuators 606*a*-606*g* convert electrical energy into linear movement of corresponding links 146*a*-146*g* (FIGS. 1A-1B). To this end, the actuators 606*a*-606*g* are in communication with the corresponding links 146*a*-146*g*. As non-limiting examples, the actuators 606*a*-606*g* may be embodied in the form electronic, pneumatic, or mechanical devices, such as linear actuators, servo motors, solenoids, or other types of actuators 606*a*-606*g*. Because the links 146*a*-146*g* are also attached to the terminals 413 (FIGS. 4A-4B) of the pick assemblies 319*a*-319*g*, movement caused by the actuators 606*a*-606*g* causes rotational motion of the corresponding pick assemblies 319*a*-319*g*.

The supports 613*a*-613*b* are attached to (or formed as part of) the enclosure 603 and may position the actuator assembly 126 away from particular components (e.g., the strings 106, a bridge, etc.) of the stringed instrument 103 so as to prevent mechanical interference with the operation of the stringed instrument 103.

The straps 616*a*-616*b* may be attached to the supports 613*a*-613*b* and may facilitate attachment of the actuator assembly 126 to the stringed instrument 103 (FIGS. 1A-1B). To this end, the straps 616*a*-616*b* may be embodied in the form of flexible or ridge material, for example. The straps 616*a*-616*b* may include hook-and-loop fasteners 619*a*-619*b* configured to be secured to corresponding hook-and-loop material (not shown) located on the stringed instrument 103. It is emphasized that other methods of attaching the actuator assembly 126 to the stringed instrument 103 may be used as well.

The carriage positioning unit 609 may be positioned on the support 613*b* and is configured to cause the ends 313*a*-313*b* (FIGS. 3A-3B) of the carriage assembly 123 (FIGS. 3A-3B) (and thus the shaft 306, rod 309, and pick assemblies 319*a*-319*g*) to move in the directions indicated by the double-headed arrow A (FIGS. 3A-3B). Accordingly, the carriage positioning unit 609 may include a housing 621, an actuator 606*h* (not visible), an arm 623, and other components not discussed in detail herein. The housing 621 may enclose the actuator 606*h* and other associated components, as may be appreciated.

Similar to the actuators 606*a*-606*g* discussed above, the actuator 606*h* may be embodied in the form of a linear actuator, a servo motor, a solenoid, or any other type of actuator 606*h*. The actuator 606*h* may be attached to the arm 623 extending outside of the housing 621 and configured to move linearly with respect to the housing 621.

The housing 621 may also include a hole 626 for the link 146*h* to pass through. The link 146*h* may also be secured to the arm 623. With the link 146*h* attached to the arm 623, movement of the arm 623 causes mechanical movement of the link 146*h*. Because the link 146*h* is also attached to the end 313*a* (FIGS. 3A-3B) of the carriage assembly 123 (FIGS. 3A-3B), movement of the arm 623 thereby causes the end 313*a* (and thus the shaft 306 (FIGS. 3A-3B) and pick assemblies 319*a*-319*g* (FIGS. 3A-3B)) to move in the directions indicated by the double-headed arrow A (FIGS. 3A-3B).

Figure 7:
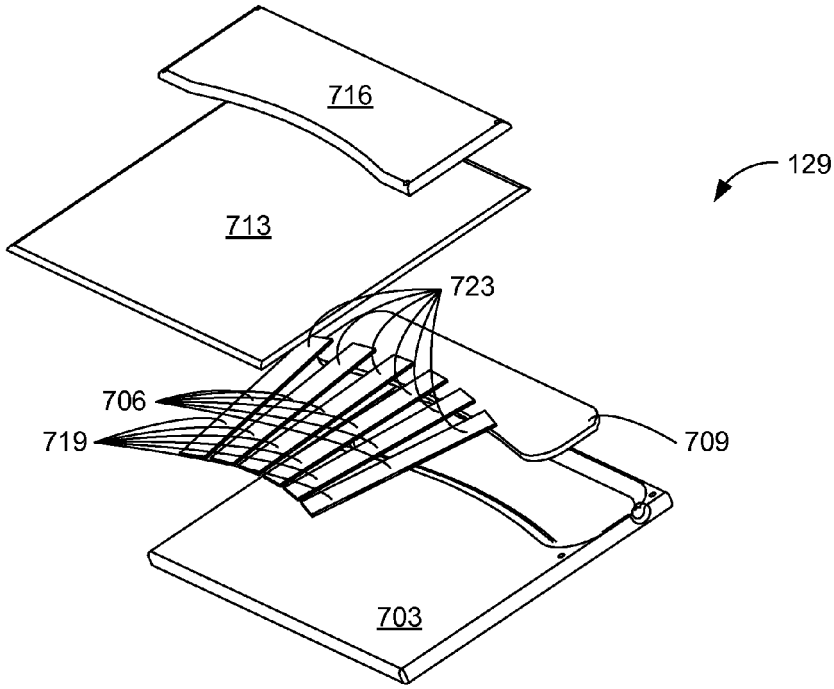
FIG. 7 is a drawing of an input device of the picking apparatus of FIG. 1 according to various embodiments of the present disclosure.

Turning now to FIG. 7, shown is the input device 129 according to various embodiments of the present disclosure. The input device 129 shown is embodied in the form of a footpad, but other embodiments of the input device 129 may include keyboards, computing devices, or other types of input devices 129. The input device 129 may include a base 703, a plurality of sensors 706, a circuit board 709, a cover 713, a cap 716, and possibly other components.

The base 703 may provide a platform for the input device 129. As such, the other components may rest on or be attached to the base 703. The circuit board 709 includes electronic components that facilitate the functionality of the input device 129, as may be appreciated. Accordingly, the circuit board 709 may comprise components that facilitate wired or wireless communication of data to the actuator assembly 126 (FIG. 6).

As a non-limiting example, the sensors 706 may be embodied in the form of pressure sensors. Furthermore, each of the sensors 706 may correspond to a particular one or more of the strings 106 (FIGS. 1A-1B). As such, pressure may be applied to (or released from) the particular sensors 706 corresponding to the strings 106 that a user wishes to sound.

As shown, first ends 719 of the sensors 706 may be spaced proximate to each other, while second ends 723 of the sensors 706 may be spaced apart. This arrangement may facilitate a user being able to cause "strumming" of multiple strings 106 by sliding a foot, for example, across the closely-spaced first ends 719. Additionally, the spaced second ends 723 may facilitate a user being able to more easily "pick" individual strings 106 by applying (or releasing) pressure to the second ends 723 of the sensors. The sensors 706 may be attached to the base 703 using various mechanisms.

The cover 713 may be placed over the sensors 706 and circuit board 709 and attached to the base 703. In various embodiments, the cover 713 may comprise a flexible material that serves to protect the various components of the input device 129 while facilitating the structure of the sensors 706 being felt through the cover 713 by a user. Additionally, the cap 716 may be placed over the cover 713 and attached to the base 703, thereby offering protection to the circuit board 709.

Next, a general description of the operation of the various components of the picking apparatus 100 is provided. The following description assumes that the picking apparatus is assembled and attached to the stringed instrument 103 as previously described. Additionally, it assumed that the various electrical components are powered, and the input device 129 is in wired or wireless data communication with the controller device 618 of the actuator assembly 126.

To begin, the picking apparatus 100 may execute an initialization process. The initialization process may involve, for example, positioning the pick assemblies 319*a*-319*g* in a default position. To this end, the controller device 618 may cause the actuators 606*a*-606*g* to retract the links 146*a*-146*g*, thereby rotating the pick assemblies 319*a*-319*g* towards the actuator assembly 126. In other words, the strings 106 may be between the surface 113 of the stringed instrument 103 and the picks 409*a*-409*b*.

The initialization process may also involve adjusting the initial position of the pick assemblies 319*a*-319*g* in the directions represented by the double-headed arrow A (FIGS. 3A-3B). This initial position may be determined, for example, during assembly of the picking apparatus 100 or when the picking apparatus 100 is installed on the stringed instrument 103.

To place the pick assemblies 319*a*-319*g* in this initialized position, the controller device 618 may cause the actuator 606*h* to adjust the arm 623, thereby extending or retracting the link 146*h*. In turn, the link 146*h*, which is attached to the end 313*a* of the carriage assembly 123, moves the shaft 306 and thus the pick assemblies 319*a*-319*g* in the directions represented by the double-headed arrow A.

As discussed above, each of the sensors 706 corresponds to one or more of the strings 106 of the stringed instrument 103. Accordingly, for brevity, the following discussion will describe the functionality of the picking apparatus 100 with respect to a single sensor 706 and corresponding one of the pick assemblies 319*a*-319*g*, herein referred to as pick assembly 319*a*. However, it is emphasized that the following description may apply to all of the sensors 706 and strings 106, and that multiple sensors 706 may be played simultaneously according to the present disclosure.

Once the picking apparatus 100 has been initialized, a user may apply pressure to the sensor 706, for example, by tapping the sensor 706. In turn, the input device 129 may convert a signal generated by the sensor 706 into data representing the intensity level at which the sensor 706 was tapped. Thereafter, the intensity level data may be transmitted to the controller device 618 in the actuator assembly 126. In alternative embodiments, instead of receiving the intensity level data from the input device 129, this signal from the sensor 706 may be transmitted to the controller device 618, and the controller device 618 may convert the signal into the intensity level data.

Upon receiving (or generating) the intensity level data, the controller device 618 may determine whether the intensity level data corresponds to an intended tap of the sensor 706 or merely corresponds to an accidental tap. To this end, the controller device 618 may determine whether the intensity level exceeds a predefined threshold. If the intensity level exceeds the threshold, the controller device 618 determines that a tap was intended. Otherwise, the controller device 618 assumes that a tap was not intended (e.g., a user may have bumped the sensor 706 upon tapping a different sensor 706).

Upon determining that a tap was intended, the controller may adjust the pick assembly 319*a* in the directions indicated by the double-headed arrow A (FIGS. 3A-3B) in order to respond to the intensity level that the sensor 706 was tapped. To this end, the controller device 618 may cause the actuator 606*h* to retract or extend the link 146*h* and adjust the carriage assembly 123. The positions that correspond to the various intensity levels may be determined during manufacturing, installation, or calibration of the picking apparatus 100. It may be determined, for example, that a high intensity tap corresponds to the junction 406 (FIG. 4B) of the pick assembly 319*a* being spaced relatively close to the string 106, while a low intensity tap corresponds to the junction 406 (FIG. 4B) being spaced farther away from the string 106.

Once the pick assembly 319*a* has been adjusted in the direction represented by the double-headed arrow A, the controller device 618 may cause the actuator 606*a* to extend the corresponding link 146*a*. The extending link 146*a* thereby causes the pick assembly 319*a* to rotate about the shaft 306. Upon the pick assembly 319*a* rotating about the shaft 306, the pick 409*a* may "pluck" the string. In this sense, the pick 409*a* may contact the string 106, pull the string 106, and release the string 106 as the pick 409*a* is moved across the string 106. Accordingly, the string 106 may be set into vibration, thereby causing sound. Thus, the pick assembly 319*a* sounds a string by rotating from a first position, with the string 106 between the surface 113 of the stringed instrument 106 and the pick 409*a*, to a second position, with the pick 409*a* between the surface 113 and the string 106. Thereafter, the controller device 618 may store the position to which the pick assembly 319*a* was rotated.

Upon the sensor 706 being tapped again, the same procedure described above may be used to determine whether the tap was intentional. If the tap was determined to be intentional, the carriage assembly 123 may adjust in response to the intensity of the tap, as described above. Then, the controller device 618 may retrieve the data representing the position to which the picking assembly 319*a* was last rotated and cause the picking assembly 319*a* to rotate in the opposite direction. Thus, in the present example, the controller device 618 may cause the actuator 606*a* to retract the link 146*a*, thereby rotating the picking assembly 319*a*. Accordingly, the picking assembly 319*a* may sound the string 106 by rotating from the second position, with the pick 409*a* between the surface 113 and the string 106, to the first position, with the string 106 between the surface 113 and the pick 409*a*. Again, the controller device 618 may store the position to which the pick assembly 319*a* was rotated for future use.

In the event that multiple sensors 706 were tapped simultaneously, the corresponding pick assemblies 319*a*-319*g* may rotate simultaneously using the same procedure as described above. To the extent that the simultaneous taps have differing intensity levels, the controller device 618 may use one of the taps to determine the positioning of the carriage assembly 123 with respect to the double-headed arrow A. In alternative embodiments, various algorithms may be used to determine the positioning of the carriage assembly 123. For example, an average of the intensity levels may be used to determine the positioning of the carriage assembly 123 with respect to the double-headed arrow A. Additionally, the rate of rotation of the pick assemblies 319*a*-319*g* may be adjusted based at least in part on the intensity levels of the taps received from the input device 129.

Furthermore, in various embodiments the pick assemblies 319*a*-319*g* may be positioned to simulate a "hand stop" (i.e., prematurely damping or stopping the vibration of one or more strings using a hand). To this end, one or more pick assemblies 319*a*-319*g* may be rotated so that one or more picks 409*a*-409*b* make contact and remain in contact with corresponding strings 106. Various procedures may be used to initiate this function. For example, separate sensors 706 may be provided. In other embodiments, the controller device 618 may detect that a sensor 706 was contacted but not released. In any event, upon determining that a "hand stop" was intended, the controller device 618 may cause the corresponding pick assemblies 319*a*-319*g* to rotate so as to contact and remain in contact with the corresponding strings 106, thereby damping vibration of (and sound from) the strings 106.

In various embodiments, the picking apparatus 100 may further facilitate switching between using the pick 409*a* and the pick 409*b*. To this end, the picking apparatus 100 may include a toggle (not shown), for example, that a user may switch to determine whether pick 409*a* or pick 409*b* is used. Upon switching the toggle, the controller device 618 may cause the actuator 606*h* to retract or extend the link 146*h*, thereby causing the carriage assembly 123 to adjust in the directions indicated by the double-headed arrow A. Additionally, the controller device 618 may re-assign the particular string(s) 106 to which each one of the pick assemblies 319*a*-319*g* correspond. Thus, the pick assemblies 319*a*-319*g* may be positioned for either the pick 409*a* or the pick 409*b* to be used.

Figure 8:
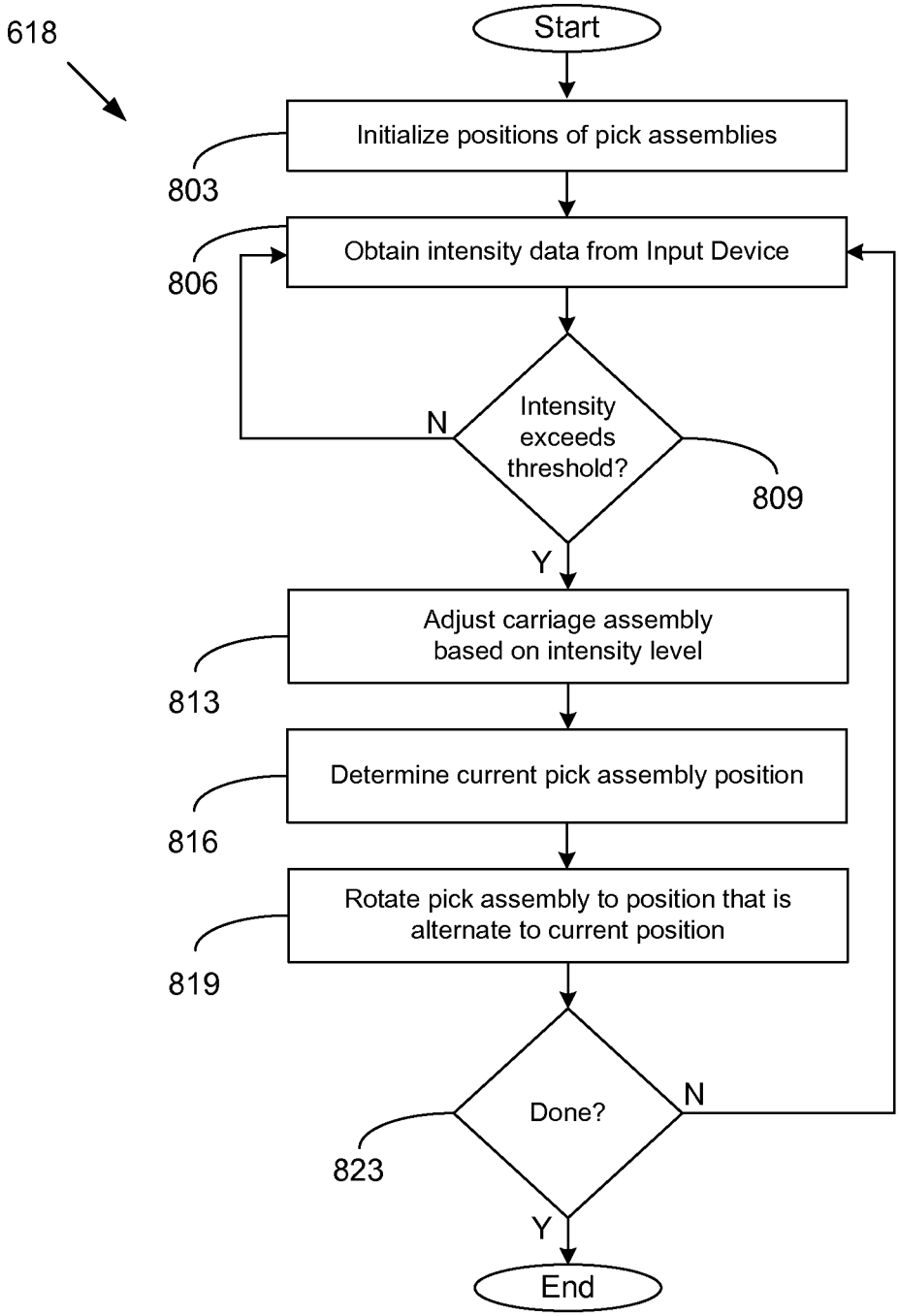
FIG. 8 is a flowchart illustrating one example of functionality implemented in the actuator assembly in the picking apparatus of FIG. 1 according to various embodiments of the present disclosure.

Referring next to FIG. 8, shown is a flowchart that provides one example of the operation of the controller device 618 according to various embodiments. It is understood that the flowchart of FIG. 8 provides merely an example of the many different types of functional arrangements that may be employed to implement the operation of the controller device 618 as described herein.

Beginning with box 803, the controller device 618 causes the carriage assembly 123 (FIGS. 1A-1B) and its corresponding pick assemblies 319*a*-319*g* (FIGS. 3A-3B) to move to their initial positions. Next, the controller device 618 obtains intensity data from sensors 706 (FIG. 7) of the input device 129 (FIGS. 1A-1B), as shown in box 806.

As depicted in box 809, the controller device 618 then determines whether the intensity level exceeds a predefined threshold. If not, the controller device 618 returns to box 806 as shown. Otherwise, the controller device 618 moves to box 813 and adjusts the carriage assembly 123 (FIGS. 1A-1B), and thus the pick assemblies 319*a*-319*g*, based on the intensity level. For example, the pick assemblies 319*a*-319*g* (FIGS. 3A-3B) may be moved in the directions indicated by the double-headed arrow A (FIGS. 3A-3B).

Thereafter, for the pick assembly 319*a*-319*g* that is to be rotated, the controller device 618 determines the current position of the pick assembly 319*a*-319*g*, as depicted in box 816. To this end, the position may be determined by obtaining stored data that represents the position, or position sensors (not shown) may be used to determine the position. Next, as shown in box 819, the controller device 618 causes the pick assembly 319*a*-319*g* to rotate to the position that is alternate to the current position (determined in box 816). In other words, if a pick assembly 319*a*-319*g* is in the first position, the controller device 618 may cause the pick assembly 319*a*-319*g* to rotate to the second position. Similarly, if a pick assembly 319*a*-319*g* is in the second position, the controller device 618 may cause the pick assembly 319*a*-319*g* to rotate to the first position.

Next, as shown in box 823, the controller device 618 determines whether the process is done. The process may be considered done, for example, upon the picking apparatus 100 (FIGS. 1A-1B) being turned off or losing power. If the process is not done, the controller device 618 moves to box 806, and the process is repeated as shown. Otherwise, the process ends.

Figure 9:
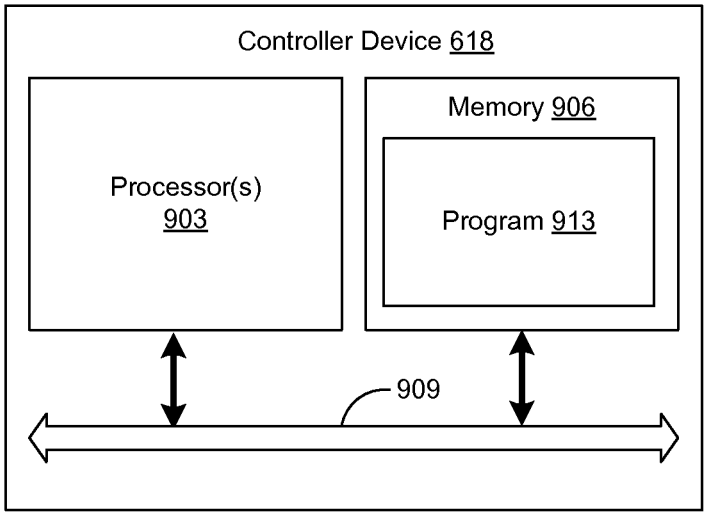
FIG. 9 is a schematic block diagram that provides one example illustration of a controller device employed in the actuator assembly of FIG. 6 according to various embodiments of the present disclosure.

With reference to FIG. 9, shown is a schematic block diagram of the controller device 618 according to an embodiment of the present disclosure. The controller device 618 includes at least one processor circuit, for example, having a processor 903 and a memory 906, both of which are coupled to a local interface 909. To this end, the controller device 618 may comprise, for example, a microcontroller. The local interface 909 may comprise, for example, a data bus with an accompanying address/control bus or other bus structure as can be appreciated.

Stored in the memory 906 are both data and several components that are executable by the processor 903. In particular, stored in the memory 906 and executable by the processor 903 may be a program 913. In addition, an operating system may be stored in the memory 906 and executable by the processor 903.

It is understood that there may be other applications that are stored in the memory 906 and are executable by the processors 903 as can be appreciated. Where any component discussed herein is implemented in the form of software, any one of a number of programming languages may be employed such as, for example, C, C++, C#, Objective C, Java, Javascript, Perl, PHP, Visual Basic, Python, Ruby, Delphi, Flash, or other programming languages.

A number of software components are stored in the memory 906 and are executable by the processor 903. In this respect, the term "executable" means a program 913 file that is in a form that can ultimately be run by the processor 903. Examples of executable programs 913 may be, for example, a compiled program 913 that can be translated into machine code in a format that can be loaded into a random access portion of the memory 906 and run by the processor 903, source code that may be expressed in proper format such as object code that is capable of being loaded into a random access portion of the memory 906 and executed by the processor 903, or source code that may be interpreted by another executable program 913 to generate instructions in a random access portion of the memory 906 to be executed by the processor 903, etc. An executable program 913 may be stored in any portion or component of the memory 906 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 906 is defined herein as including both volatile and nonvolatile memory and data storage components. Volatile components are those that do not retain data values upon loss of power. Nonvolatile components are those that retain data upon a loss of power. Thus, the memory 906 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 903 may represent multiple processors 903 and the memory 906 may represent multiple memories 906 that operate in parallel processing circuits, respectively. In such a case, the local interface 909 may be an appropriate network that facilitates communication between any two of the multiple processors 903, between any processor 903 and any of the memories 906, or between any two of the memories 906, etc. The local interface 909 may comprise additional systems designed to coordinate this communication, including, for example, performing load balancing. The processor 903 may be of electrical or of some other available construction.

Although various systems described herein may be embodied in dedicated hardware as discussed above, as an alternative the same may also be embodied in software or code executed by general purpose hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowchart of FIG. 8 shows the functionality and operation of an implementation of portions of the controller device 618. If embodied in software, each block may represent a module, segment, or portion of code that comprises program 913 instructions to implement the specified logical function(s). The program 913 instructions may be embodied in the form of source code that comprises human-readable statements written in a programming language or machine code that comprises numerical instructions recognizable by a suitable execution system such as a processor 903 in a computer system or other system. The machine code may be converted from the source code, etc. If embodied in hardware, each block may represent a circuit or a number of interconnected circuits to implement the specified logical function(s).

Although the flowchart of FIG. 8 shows a specific order of execution, it is understood that the order of execution may differ from that which is depicted. For example, the order of execution of two or more blocks may vary from the order shown. Also, two or more blocks shown in succession in FIG. 8 may be executed concurrently or with partial concurrence. Further, in some embodiments, one or more of the blocks shown in FIG. 8 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

It is emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus, comprising:

a carriage assembly configured to attach to a stringed instrument, the stringed instrument comprising a surface that faces a plurality of strings, the carriage assembly comprising a plurality of picks configured to sound the strings;

wherein at least one of the picks is configured to:

in response to data received from an input device, sound one of the strings by moving from a first position, with the strings between the one of the picks and the surface, to a second position, with the one of the picks between the surface and the strings; and in response to data received from the input device, sound the one of the strings by moving from the second position, with the one of the picks between the surface and the strings, to the first position, with the strings between the one of the picks and the surface.

2. The apparatus of claim 1, wherein:

the carriage assembly further comprises a shaft extending between a first end of the carriage assembly to a second end of the carriage assembly; and the picks are attached to a plurality of pick assemblies rotatably mounted to the shaft.

3. The apparatus of claim 2, wherein:

the data from the input device further comprises data corresponding to an intensity level; and in response to the intensity level, the shaft is configured to adjust in position with respect to the strings.

4. The apparatus of claim 1, further comprising a mount assembly configured to attach to the surface of the stringed instrument, wherein the carriage assembly is configured to removably attach to the mount assembly.

5. The apparatus of claim 4, wherein the mount assembly further comprises a telescoping rod configured to extend a plurality of braces against an edge of a sound hole of the stringed instrument.

6. The apparatus of claim 1, wherein at least one of the pick assemblies further comprises a plurality of picks comprising differing characteristics selected from the group consisting of a shape, a texture, and a hardness.

7. The apparatus of claim 1, wherein the picks are axially symmetrical.

8. The apparatus of claim 1, further comprising a plurality of actuators, each actuator configured to move one of the pick assemblies from the first position to the second position.

9. The apparatus of claim 8, wherein the input device further comprises a plurality of intensity sensors, each of the intensity sensors corresponding to at least one of the actuators.

10. A method, comprising the steps of:

generating data using an input device that is configured to provide intensity data;

communicating the intensity data to a controller of a carriage assembly, the carriage assembly comprising a plurality of picks and being attached to a stringed instrument having a surface that faces a plurality of strings; and moving, responsive to the intensity data, one of the picks from a first position, with the strings between the surface and the one of the picks, to a second position with the one of the picks between the surface and the strings, thereby sounding one of the strings based at least in part on a user input.

11. The method of claim 10, further comprising the step of moving the pick from the second position to the first position, thereby sounding the one of the strings.

12. The method of claim 10, wherein the step of moving one of the picks from the first position to the second position further comprises rotating a pick assembly about a shaft extending between a first end of the carriage assembly and a second end of the carriage assembly.

13. The method of claim 12 further comprising the step of, in response to the intensity data, adjusting a position of the shaft with respect to the strings.

14. The method of claim 12 further comprising the step of, in response to the intensity data, adjusting a rate of rotation of the one of the picks.

15. The method of claim 10 further comprising the steps of:

extending a plurality of braces of a mount assembly against an edge of a sound hole of the stringed instrument; and attaching the carriage assembly to the mount assembly.

16. The method of claim 10, further comprising the step of determining whether to move the one of the picks based at least in part on the data.

17. The method of claim 16, wherein the step of determining whether to move the one of the picks is further based at least in part on an intensity level received from the input device.

18. An apparatus, comprising:

a mount assembly configured to attach to a stringed instrument, the stringed instrument having a surface that faces a plurality of strings, the mount assembly comprising:

a plurality of braces; and a telescoping rod configured to extend the braces against an edge of a sound hole of the stringed instrument;

a carriage assembly configured to couple to the mount assembly, the carriage assembly comprising:

a shaft extending between a first end of the carriage assembly and a second end of the carriage assembly; and a plurality of pick assemblies rotatably mounted to the shaft, each of the pick assemblies comprising a pick configured to sound at least one of the strings;

an actuator assembly configured to removably attach to the stringed instrument, the actuator assembly comprising a plurality of actuators in communication with the pick assemblies, each of the actuators configured to rotate at least one of the pick assemblies; and an input device in communication with the actuator assembly, the input device comprising a plurality of sensors, each of the sensors corresponding to at least one of the strings.

19. The apparatus of claim 18, wherein:

the pick assemblies are further configured to rotate from a first position, with the strings between the picks and the surface, to a second position, with the picks between the surface and the strings; and at least one of the pick assemblies is further configured to rotate to a damping position, wherein the at least one of the pick assemblies dampens a vibration of at least one of the strings.

20. The apparatus of claim 18, wherein:

the input device transmits intensity level data to the actuator assembly; and a position of the shaft is configured to adjust in response to the intensity level data.

* * * * *